US007146014B2

(12) United States Patent
Hannah

(10) Patent No.: US 7,146,014 B2
(45) Date of Patent: Dec. 5, 2006

(54) MEMS DIRECTIONAL SENSOR SYSTEM

(75) Inventor: Eric C. Hannah, Pebble Beach, CA (US)

(73) Assignee: Intel Corporation, Santa Clara, CA (US)

( * ) Notice: Subject to any disclaimer, the term of this patent is extended or adjusted under 35 U.S.C. 154(b) by 878 days.

(21) Appl. No.: 10/167,213

(22) Filed: Jun. 11, 2002

(65) Prior Publication Data

US 2003/0228025 A1 Dec. 11, 2003

(51) Int. Cl.
*H04R 3/00* (2006.01)

(52) U.S. Cl. ..... 381/92; 381/356; 367/123

(58) Field of Classification Search ..... 381/113, 381/92, 91, 122, 95, 58, 356, 111–115, 174; 367/118, 129, 123–125
See application file for complete search history.

(56) References Cited

U.S. PATENT DOCUMENTS

| | | | | |
|---|---|---|---|---|
| 4,239,356 | A | 12/1980 | Freudenschuss et al. | 354/23 R |
| 4,312,053 | A | 1/1982 | Lipsky | 367/127 |
| 4,332,000 | A | 5/1982 | Petersen | 361/283 |
| 4,400,724 | A | 8/1983 | Fields | 358/85 |
| 4,558,184 | A | 12/1985 | Busch-Vishniac et al. | 179/111 |
| 4,639,904 | A | 1/1987 | Riedlinger | 367/140 |
| 5,028,894 | A | 7/1991 | Speake | 333/174 |
| 5,099,456 | A | 3/1992 | Wells | 367/127 |
| 5,316,619 | A | 5/1994 | Mastrangelo | 156/644 |
| 5,573,679 | A | 11/1996 | Mitchell et al. | 216/2 |
| 5,625,410 | A | 4/1997 | Washino et al. | 348/154 |
| D381,024 | S | 7/1997 | Hinzmann et al. | D14/225 |
| 5,664,021 | A | 9/1997 | Chu et al. | 381/92 |
| 5,686,957 | A | 11/1997 | Baker | 348/36 |
| 5,696,662 | A | 12/1997 | Bauhahn | 361/298.1 |
| D389,839 | S | 1/1998 | Woodman et al. | D14/227 |
| 5,715,319 | A | 2/1998 | Chu | 381/26 |
| 5,742,693 | A | 4/1998 | Elko | 381/92 |
| 5,778,082 | A | 7/1998 | Chu et al. | 381/92 |
| 5,787,183 | A * | 7/1998 | Chu et al. | 381/92 |
| 5,793,875 | A | 8/1998 | Lehr et al. | 381/68.1 |
| 5,815,580 | A | 9/1998 | Craven et al. | 381/58 |
| 5,856,722 | A | 1/1999 | Haronian et al. | 310/321 |
| 5,928,311 | A | 7/1999 | Leavy et al. | 708/300 |
| 6,122,444 | A | 9/2000 | Shen et al. | |
| 6,185,152 | B1 | 2/2001 | Shen | 367/118 |
| 6,243,474 | B1 | 6/2001 | Tai et al. | 381/174 |
| 6,249,075 | B1 * | 6/2001 | Bishop et al. | 310/338 |

(Continued)

FOREIGN PATENT DOCUMENTS

| | | |
|---|---|---|
| EP | 0374902 | 6/1990 |

(Continued)

OTHER PUBLICATIONS

"Concorde 4500 Including System 4000ZX Group Videoconferencing System" *Copyright 1997 PictureTel Corporation*, hosted by Onward Technologies, Inc., 2 pages.

(Continued)

*Primary Examiner*—Vivian Chin
*Assistant Examiner*—Jason Kurr
(74) *Attorney, Agent, or Firm*—Schwegman, Lundberg, Woessner & Kluth, P.A.

(57) ABSTRACT

A MEMS directional sensor system capable of determining direction from a microphone to a sound source over a wide range of frequencies is disclosed. By utilizing a parallel filter bank that relies on a slow wave structure in a MEMS device, such as described herein, a very small microphone, on the order of a few micrometers, can be designed with unsurpassed ability to detect a sound source location.

26 Claims, 4 Drawing Sheets

U.S. PATENT DOCUMENTS

| | | | | |
|---|---|---|---|---|
| 6,252,544 | B1 | 6/2001 | Hoffberg | 342/357.1 |
| 6,317,703 | B1 * | 11/2001 | Linsker | 702/190 |
| 6,347,237 | B1 | 2/2002 | Eden et al. | 505/210 |
| 6,704,422 | B1 * | 3/2004 | Jensen | 381/313 |
| 6,795,558 | B1 * | 9/2004 | Matsuo | 381/92 |
| 2002/0048376 | A1 * | 4/2002 | Ukita | 381/92 |
| 2002/0118850 | A1 * | 8/2002 | Yeh et al. | 381/313 |
| 2002/0149070 | A1 * | 10/2002 | Sheplak et al. | 257/415 |
| 2003/0063762 | A1 * | 4/2003 | Tajima et al. | 381/111 |

FOREIGN PATENT DOCUMENTS

| | | |
|---|---|---|
| EP | 0398595 | 11/1990 |
| EP | 0782368 | 7/1997 |

OTHER PUBLICATIONS

"Developer's ToolKit For Live 50/100 and Group Systems", *Copyright 1997 PictureTel Corporation*, hosted by Onward Technologies, Inc., 2 pages.

"LimeLight Dynamic Speaker Locating Technology", *Copyright 1997 PictureTel Corporation*, hosted by Onward Technologies, Inc., 3 pages.

"Product Specifications, Concorde 4500 Including System 400ZX Group Videoconferencing System", *Copyright 1997 PictureTel Corporation*, hosted by Onward Technologies, Inc., 5 pages.

"The Claria Microphone System", *Telex Communications, Inc.*, (1999), 1 page.

"Virtuoso Advnaced Audio Package", *Copyright 1997 PictureTel Corporation*, hosted by Onward Technologies, Inc., 1 page.

Begault, Durand. R., *3-D Sound for Virtual Reality and Multimedia*, Academic Press, Inc., Chestnut Hill, MA, (1994), table of contents, 5 pages.

Bergvist, J., et al., "Capacitive Microphone with a Surface Micromachined Backplate Using Electroplating Technology", *Journal of Microelectromechanical Systems*, 3 (2), (Jun. 1994), pp. 69-75.

Bernstein, J., "A Micromachined Condenser Hydrophone", *IEEE Solid-State Sensor and Actuator Workshop*, Hilton Head Island, SC, (1992), pp. 161-165.

Bernstein, J., et al., "Advanced Micromachined Condenser Hydrophone", *Solid-State Sensor and Actuator Workshop*, Hilton Head, SC, (1994), pp. 73-77.

Crossman, A., "Summary of ITU-T Speech/Audio Codes Used in the ITU-T Videoconferencing Standards", *PictureTel Corporation*, (Jul. 1, 1997), 1 page.

Gibbons, C., et al., "Design of a Biomimetic Directional Microphone Diaphragm", *Proceedings of the ASME Noise Control and Acoustics Division*, (2000), pp. 173-179.

Kendall, G.S., et al., "A Spacial Sound Processor for Loudspeaker and Headphone Reproduction", *AES 8th International Conference*, pp. 209-221.

Mason, A.C., et al., "Hyperacute directional hearing in a microscale auditory system", *Nature. 410*, (Apr. 2001), pp. 686-690.

Scheeper, P.R., et al., "Fabrication of Silicon Condenser Microphones using Single Wafer Technology", *Journal of Microelectromechanical Systems. 1* (3), (Sep. 1992), pp. 147-154.

Scheeper, P.R., et al., "Improvement of the performance of microphones with a silicon nitride diaphragm and backplate", *Sensors and Actuators A. 40*, (1994), pp. 179-186.

Walsh, S.T., et al., "Overcoming stiction in MEMS manufacturing", *Micro. 13* (3), (Mar. 1995), pp. 49-58.

Wrightman, F.L., et al., "Headphone simulation of free-field listening.I:Stimulus synthesis", *J. Axoust. Soc. Am.*, 85 (2), (Feb. 1989), pp. 858-867.

Hijab, R. S., et al., "Micromechanical Thin-Film Cavity Structures for Low Pressure and Acoustic Transducer Applications", *Third International Conference on Solid-State Sensors and Actuators—Transducers '85*, (Jun. 11, 1985), 178-181.

* cited by examiner

MEMS DIRECTIONAL SENSOR SYSTEM

FIELD

This invention relates generally to directional electroacoustic sensors and, in particular, the present invention relates to a microelectromechanical systems (MEMS) directional sensor system.

BACKGROUND

Determining the direction of a sound source with a miniature receiving device is known in the art. Much of this technology is based on the structure of a fly's ear (*Ormia ochracea*). Through mechanical coupling of the eardrums, the fly has highly directional hearing to within two degrees azimuth. The eardrums are known to be less than about 0.5 mm apart such that localization cues are around 50 nanoseconds (ns). See, Mason, et al., *Hyperacute Directional Hearing in a Microscale Auditory System*, Nature, Vol 410, Apr. 5, 2001.

A number of miniature sensor designs exist with various methods and materials being used for their fabrication. One such type of sensor is a capacitive microphone. Organic films have often been used for the diaphragm in such microphones. However, the use of such films is less than ideal because temperature and humidity effects on the film result in drift in long-term microphone performance.

This problem has been addressed by making solid state microphones using semiconductor techniques. Initially, bulk silicon micromachining, in which a silicon substrate is patterned by etching to form electromechanical structures, has been applied to manufacture of these devices. Such MEMS microphones have typically been based on the piezoelectric and piezoresistive principles. Many of the recent efforts, however, have focused on fabrication of small, non-directional capacitive microphone diaphragms made using surface micromachining. Such microphones have sometimes been paired together to create a directional microphone system, but have experienced performance problems.

Other attempts at producing miniature directional microphones involve using filters having a slow wave structure with a certain delay time. However, such attempts have been limited to devices that are tuned to a specific frequency or frequency range, i.e., broadband or narrow band. For example, microphones in hearing aids can be tuned to obtain adequate directional detection for human speech, which is typically between a few hundred to a few thousand Hertz (Hz). Other microphones may be tuned to pick up the sound of a whistle at 5000 Hz, for example. The only means of detecting a wide range of frequencies at the same time with such devices would be to couple several microphones together, each tuned to a different frequency. Such an approach is not only costly and impractical, it is likely subject to performance problems as well.

For the reasons stated above, there is a need in the art for a miniature microphone system capable of detecting a sound source location over a wide frequency range.

DETAILED DESCRIPTION

A MEMS directional sensor system capable of detecting the direction of acoustic signals arriving from an acoustic source over a wide range of frequencies is disclosed. The following description and the drawings illustrate specific embodiments of the invention sufficiently to enable those skilled in the art to practice it. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of the invention encompasses the full ambit of the claims and all available equivalents.

Figure 1:
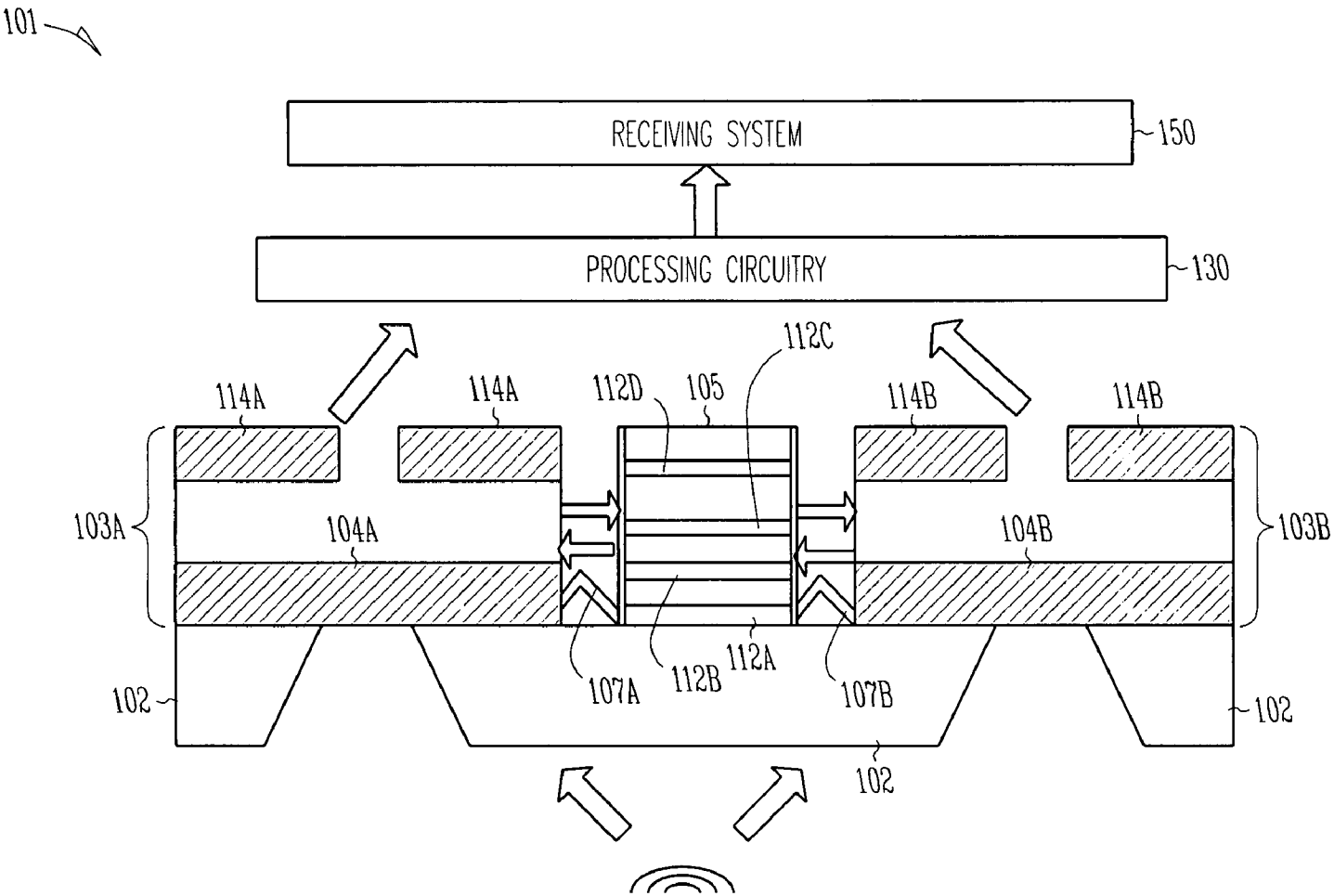
FIG. 1 is a simplified cross-sectional view of a MEMS directional microphone system having two acoustic sensors coupled to a filter bank in a first embodiment of the present invention.

FIG. 1 shows a simplified cross-sectional view of a representative integrated electroacoustic sensor system within the present subject matter. It will be appreciated that although only the sensor system is shown, other components may also be incorporated at other portions of the semiconductor substrate to form an integrated circuit. In one embodiment, the sensor system is a transducer system. In the embodiment shown in FIG. 1, the integrated electroacoustic sensor system is a directional microphone system 101. The directional microphone system 101 resides on a substrate 102, usually <100> silicon, although any suitable substrate material can be used. In this embodiment, the directional microphone system 101 contains two acoustic sensors 103A and 103B. The acoustic sensors 103A and 103B each comprise diaphragms 104A and 104B, respectively, and back plates 114A and 114B, respectively. Each diaphragm 104A and 104B is separated from its respective backplate by an air gap and is preferably a MEMS diaphragm, consisting of an electrode attached to a flexible support member.

In one embodiment, the acoustic sensors 103A and 103B are capacitive sensors, such as condenser microphone diaphragm sensors. As such, the diaphragms, 104A and 104B, and the back plates, 114A and 114B, respectively, function as the plates of the capacitor. As shown in FIG. 1, the diaphragms 104A and 104B are coupled to a filter bank 105 containing an array of overlapping, narrow-band tuned filters 112A–112D via mechanical coupling devices 107A and 107B. In other embodiments, three or more acoustic sensors are used (See FIG. 4).

Each of the acoustic sensors 103A and 103B is adapted for receiving an acoustic signal from a sound source 110 and sending a sensor output signal representative of the received acoustic signal to the processing circuitry 130. Each sensor 103A and 103B is further adapted to transfer mechanical movement from its respective diaphragm, 104A and 104B, to the filters 112A–112D located in the filter bank 105. In FIG. 1, filters 112A–112D are shown, although the invention is not so limited. Any suitable number of filters can be used. The filters 112A–112D are adapted to delay the mechanical movement of a first diaphragm, e.g., 104A, by several radians, independent of the frequency. The delayed mechanical perturbation is mechanically coupled to a second diaphragm, e.g., 104B, and produces a movement in the second diaphragm, which varies the capacitance. It is the change in capacitance that is interpreted by the processing circuitry 130 as an electrical signal. The processing circuitry 130 then generates a direction-indicating signal that is sent to a receiving system 150. In this way, the direction, i.e., heading, from the microphone system 101 to the sound source 110 is determined.

In other words, at each diaphragm, the addition of the direct acoustic excitation plus the delayed, filter bank excitation results in a combined response that implicitly encodes the direction of the sound wave. Because the filter bank 105 delays each Fourier component by a fixed number of radians, there is significant modulation of the direct acoustic response of both diaphragms 104A and 104B for all frequencies and for all directions of the incident acoustic wave.

In an alternative embodiment, the sensors 103A and 103B are tilted about 90 degrees from what is shown in FIG. 1 so that the sound receiving preferred axes are 180 degrees apart from each other (similar to the human ear). In this way, the coupling through the mechanical coupling devices 107A and 107B clearly vibrates the diaphragms 104A and 104B on the same axis, though reversed in phase.

The processing circuitry 130 is designed to consider the time spread between the directly received sound pulses which are inherently received at the diaphragms with a time separation dependent on the different lengths of the paths to each of the sensors. Because the path length variation is so small for MEMS sensors, more information is necessary to calculate the heading to the sound source. Thus, the processing circuitry 130 also considers the time delay between detection of the initial pulse received by a sensor and the receipt of the delayed, filter-modified perturbation to the diaphragm, which generates an electrical signal in response to the perturbation. In another embodiment, the time delay between the receipt of the input pulse on a first sensor and its receipt on a second sensor is also used by the processing circuitry 130 to obtain the direction-indicating signal. Thus, the processing circuitry 130 is capable of using all of the various time delays to calculate the bearing relative to the sensor from which the sound is coming.

In other words, the processing circuitry 130 inverts the dual diaphragm signals to derive both the time series of the incident acoustic wave and its direction of propagation. This is done in either the Fourier domain or by use of a windowed Wavelet transform. At each frequency, the incident excitation for both sensors is easily calculated, given knowledge of the filter bank's transfer function. As a result, the time series and directionality can be derived. Inverse Fourier transforming (or the equivalent back Wavelet transform) then produces the acoustic wave's time series and the direction of each Fourier component as a function of time.

The diaphragms, 104A and 104B, can be constructed according to any suitable means known in the art. In most embodiments, each diaphragm is comprised of a dielectric layer and a conductive layer. Similarly, each back plate 114A and 114B typically has a dielectric layer, a conductive layer, and is perforated with one or more acoustic holes that allow air to flow into and out of the air gap. Acoustic pressure incident on the diaphragm causes it to deflect, thereby changing the capacitance of the parallel plate structure. The change in capacitance is processed by other electronics to provide a corresponding electrical signal. Although not shown, in certain embodiments, sacrificial layers are used to separate each diaphragm from its respective back plate. In such embodiments, diffusion barriers can also be used to isolate the conductive layers (of the diaphragm and back plate) from the sacrificial layers.

Dielectric layers used in various embodiments of the present invention are made from any suitable dielectric material, such as silicon nitride or silicon oxide, and can be any suitable thickness, such as about 0.5 to two (2) microns. Sacrificial layers are also made from any suitable sacrificial material, such as aluminum or silicon. Diffusion barriers can be made from materials such as silicon oxide, silicon nitride, silicon dioxide, titanium nitride, and the like, and can be any suitable thickness, such as about 0.1 to 0.4 micrometers. Conductive layers are essentially capacitor electrodes that can be made from any suitable metal, such as gold, copper, aluminum, nickel, tungsten, titanium, titanium nitride, including compounds and alloys containing these and other similar materials. Such layers can be about 0.2 to one (1) micrometer thick, although the invention is not so limited.

The directional microphone system 101 can be comprised of any suitable mechanisms capable of transforming sound energy into electrical energy and of producing the desired frequency response. A capacitive microphone according to the present subject matter can take a variety of shapes and sizes. Capacitive microphones further can be either electret microphones, which are biased by a built-in charge, or condenser microphones, which have to be biased by an external voltage source. It is noted that although electret microphones can be used in alternative embodiments of the present invention, they require mechanical assembly and constitute components that are quite separate from the integrated circuitry with which they are used. Other microphones which can be used include, but are not limited to, carbon microphones, hot-wire or thermal microphones, electrodynamic or moving coil microphones, and so forth.

Each mechanical coupling means 107A and 107B is preferably a MEMS device having etched silicon members. Each mechanical coupling means is further preferably connected to the movable portion of its respective diaphragm member and designed to allow the diaphragm member to flex unrestricted. In one embodiment, each mechanical coupling means 107A and 107B is a small pivoted or hinged spring-like device that is connected to the short edge of its respective diaphragm. Each such device further has a stiffness sufficient to allow the diaphragm to flex unrestricted in the longitudinal direction. In another embodiment, each mechanical coupling means is connected to the underside (or even the top side) of the diaphragm, such that it flexes in the same direction as the diaphragm.

In other words, both coupling means 107A and 107B are directly driven by acoustic action and, simultaneously, by the filter bank 105. In an electrical equivalent circuit, the two inputs are added together. The filter action is applied along the same axis that the acoustic energy activates. In one embodiment, a mechanical rocker arm that bi-directionally couples energy between the diaphragm and the filter bank is used. The rocker arm must be stiff enough to couple vibrations efficiently up to the filter bank cutoff. This filter-diaphragm connection is preferably a passive system, not an amplified, active system. In this way, noise and nonlinearities are not introduced. In another embodiment, however, the system is an active system that does have added noise and nonlinear performance. Such a system is particularly useful for large excitations.

The filter bank 105 is comprised of a parallel array of highly-tuned filters. In one embodiment each tuned filter is a digital filter comprising a MEMS spring and mass mechanism, with a suitable rocker arm arrangement as is known in the art. Such devices are preferably etched out of silicon, although the invention is not so limited. Any suitable MEMS-based material can be used.

Figure 2:
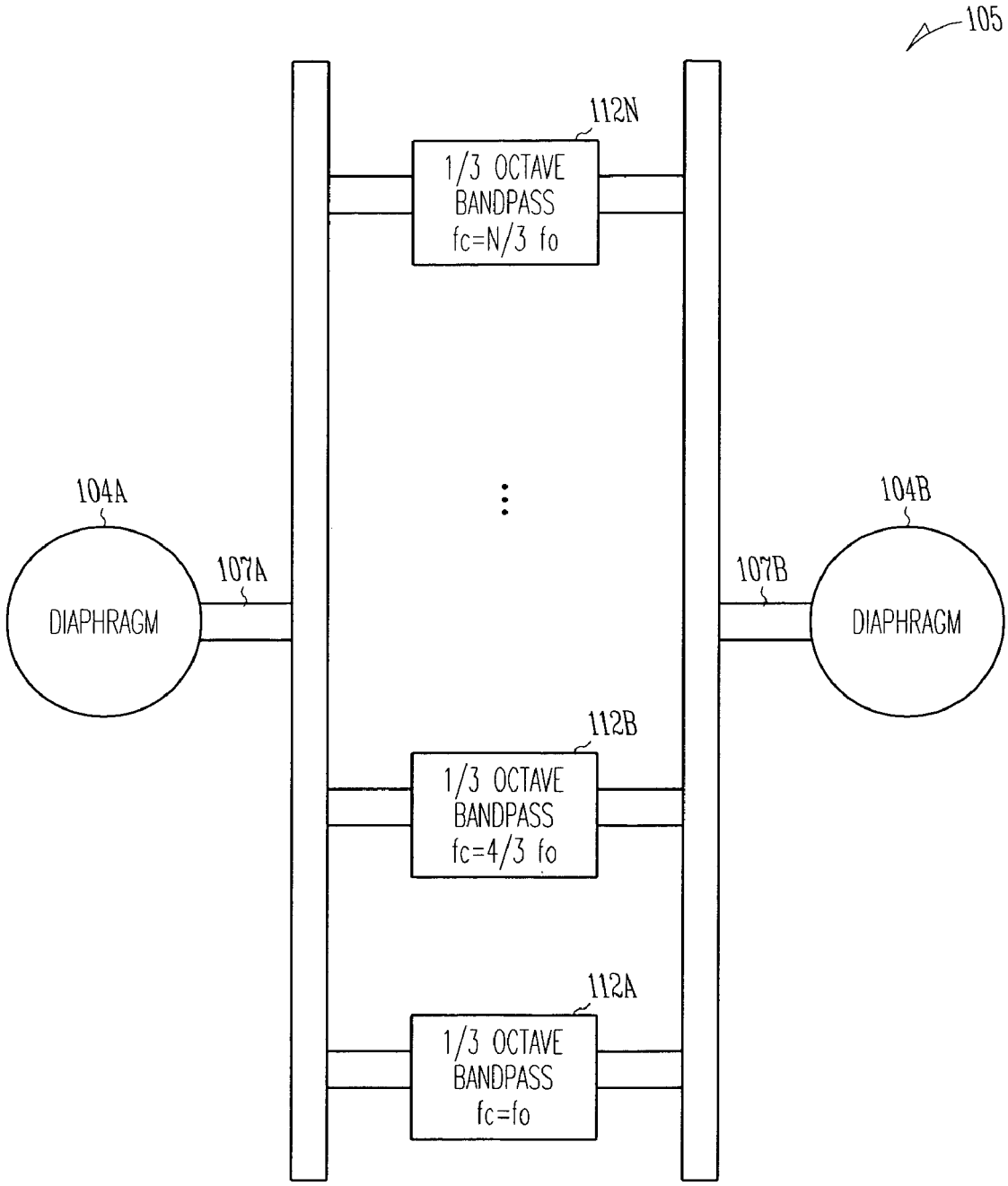
FIG. 2 is a simplified diagram of the filter bank coupled to diaphragms in the two acoustic sensors of FIG. 1.

As shown in FIG. 2, the filter bank 105 comprises a parallel bank of pass band filters 112A–112N, i.e., bandpass acoustic filters, coupled by the mechanical coupling devices 107A and 107B between each of the at least two acoustic diaphragms 104A and 104B. Each of the filters has a pass band, the pass bands arranged for delaying sensor output signals by several wavelengths over a predetermined range of frequencies, such as from subsonic to supersonic. In the embodiment shown in FIG. 2, each successive filter is shifted up in frequency by ⅓ octave from the former, such that the fundamental frequency ($f_o$) (number of complete cycles per unit time) in filter 202A is the same as the tuned or resonant frequency ($f_c$), $f_c$=4/3 $f_o$ in filter 202B and $f_c$=N/3 $f_o$ in filter 202N. In other embodiments, the parallel bank is comprised of ¼ octave filters or ⅛ octave, ½ octave, and so forth.

The number (N) of filters can vary from two (2) to approximately twenty (20). However, systems with minimal numbers of filters, such as a two-filter system, would provide only a very limited response frequency-range system. Increasing the number of filters increases the system's response, although there is a practical limit, depending on a particular application, beyond which additional filters would not be desirable for a number of reasons, such as cost, space constraints, and so forth. Generally, the smaller the octave shift between filters, the more filter elements are required for a given level of discrimination. The precise number of filter elements is a design consideration based on a trade-off between discrimination and variation in discrimination capabilities versus frequency range desired for a particular application. Such a determination can be made through appropriate optimization studies. In one embodiment, the frequency range is between about 100 Hz and 10 kHz. In a particular embodiment, the 10 kHz system includes 20⅓ octave filters.

The filters utilize a slow wave structure as is known in the art. Essentially, the filters work together to delay the mechanical movement of each diaphragm by a few radians phase shift at all frequencies. Such delays range from very short delays between about 10 and 100 microseconds for ultrasonic applications to much longer delays on the order of about one millisecond or more for the audible range. As a result, the filter bank 105 provides wide band ability to receive sounds ranging from subsonic to supersonic bandwidths, i.e., less than 15 Hz up to greater than 20 kHz.

Although each bandpass filter is tuned, the filter bank 105 as a whole is not considered a tuned device. Therefore, for each frequency, sound energy takes a different path through the filter bank 105, thus allowing the filter bank 105 to control the phase shift for each frequency. Although the result is not equivalent to a spectrally flat material, the amplitude of energy passed across the filter bank 105 is "flat" while the time delay is highly frequency-dependent such that a roughly constant phase shift across all frequencies is provided.

In operation, the amplitude and phase of the movements of each of the diaphragms in response to incoming sound, plus the cross-coupled, delayed component produced by the other diaphragm are detected by the system. Specifically, acoustic energy of a given frequency will only propagate through the particular filter having the correct passband. That filter phase shifts the passed Fourier components by a few radians. The parallel, off-frequency filters reject these frequencies and do not subtract or transmit mechanical energy from the wave. Thus, all frequency components of incident acoustic waves will have a directionally determined phase shift between the two diaphragms. This permits precise direction determination for waves of any frequency or combination of frequencies. In other embodiments, other time delays can also be detected, such as the time delay between receipt of the input pulse on a first sensor and its receipt on a second sensor.

The directional microphone system described herein is essentially substituting for a human "listener." In order for any listener to determine the direction and location of a virtual sound source, i.e., localize the sound source, it is first necessary to determine the "angular perception." The angular perception of a virtual sound source can be described in terms of azimuth and elevational angles. Therefore, in one embodiment, the present invention determines an azimuth angle, and if applicable, an elevational angle as well, so that the directional microphone system can localize a sound source.

Figure 3:
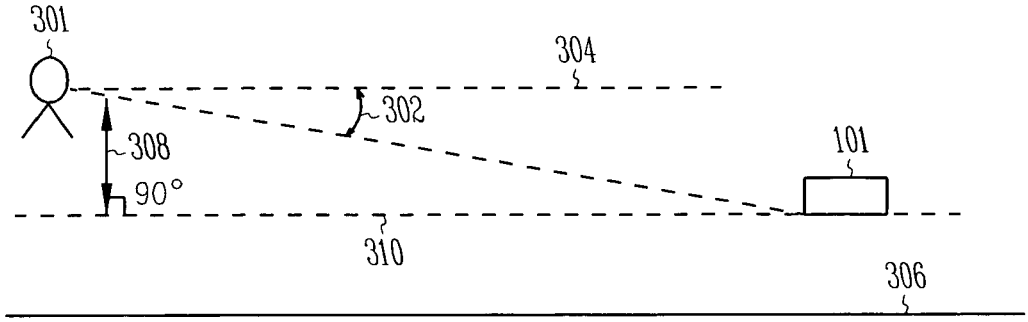
FIG. 3 is a simplified schematic illustration showing the geometry of azimuth and elevational angles with respect to a directional microphone system receiving an acoustic signal from a sound source in one embodiment of the present invention.

As shown in FIG. 3, the azimuth angle 302 refers to the relative angle of the sound source 301 on a first horizontal plane 304 parallel to ground level 306. The elevational angle 308 refers to the angular distance of a fixed point, such as the sound source 301, above a horizontal plane of an object, such as above a second horizontal plane 310 of the directional microphone system 101. Normally, azimuth is described in terms of degrees, such that a sound source 301 located at zero (0) degrees azimuth and elevation are at a point directly ahead of the listener, in this case, the directional microphone system 101. Azimuth can also be described as increasing counterclockwise from zero to 360 degrees along the azimuthal circle. The azimuth angle in FIG. 3 is about 30 degrees and the elevational angle 306 is about 60 degrees. The linear distance between the sound source 301 and the directional microphone system 101 can be referred to as a perceived distance, although it is not necessary to directly compute this distance when localizing the sound source 301.

The sound source 301 can be any suitable distance away from the directional microphone system 101 as long as the system can function appropriately. In one embodiment, the sound source 301 is between about one (1) m and about five (5) m away from the directional microphone system 101. If the sound source 301 is too close, the associated signal becomes so large that it is difficult to accurately distinguish direction. If the sound source 301 is too far away, it becomes difficult to differentiate the sound source 301 from ongoing background noise. In one embodiment, background noise is accommodated by programming a controller coupled to the directional microphone system 101 with a suitable algorithm. For example, the system can be operated initially with only background or environmental noise present so that a baseline can be established. Once the desired sound source 301 begins, only signals above the baseline are considered by the system. Any signals which are occurring at the baseline or below are effectively ignored or "subtracted," i.e., only the sound waves one sine greater in proportion to the background noise are considered.

Any suitable type of processing circuitry known in the art can be used to process the signals generated by the system. Signal processors typically include transformers, which, in turn, include an analyzer that further processes the digital signals. Any suitable algorithm can be used to analyze the signals, which include selecting a predetermined percentage or value for data reduction. In one embodiment, a Principal Components Analysis (PCA) or variation thereof is used, such as is described in U.S. Pat. No. 5,928,311 to Leavy and Shen, assigned to the same Assignee and entitled, "Method and Apparatus for Constructing a Digital Filter." In another embodiment, the incoming digital signal is converted from a time domain to a frequency domain by performing an integral transform for each frame. Such transform can include Fourier analysis such as the inverse fast Fourier transform (IFFT), the fast Fourier transform (FFT), or by use of a windowed Wavelet transform method, as noted above.

The specific calculations comprising the FFT are well-known in the art and will not be discussed in detail herein. Essentially, a Fourier transform mathematically decomposes a complex waveform into a series of sine waves whose amplitudes and phases are determinable. Each Fourier transform is considered to be looking at only one "slice" of time such that particular spectral anti-resonances or nulls are revealed. In one embodiment, the analyzer takes a series of 512 or 1024 point FFT's of the incoming digital signal. In another embodiment, a system analyzer uses a modification of the algorithm described in U.S. Pat. No. 6,122,444 ('444) to Shen, assigned to the same Assignee and entitled, "Method and Apparatus for Performing Block Based Frequency Domain Filtering." Since '444 describes an algorithm for "generating" three-dimensional sound, the modifications would necessarily include those which would instead incorporate parameters for "detecting" three-dimensional sound.

Through the use of spectral smoothing, a signal processor used in one embodiment of the present invention can also be programmed to ignore certain sounds or noise in the spectrum, as is known in the art. The signal processor can further be programmed to ignore interruptions of a second sound source for a certain period of time, such as from one (1) to five (5) seconds or more. Such interruptions can include sounds from another sound source, such as another person and mechanical noises, e.g., the hum of a motor. If the sounds from the second sound source, such as the voice of another person, continue after the predetermined period, then the system can be programmed to consider the sound from the secondary sound source as the new primary sound source.

The system can also be designed to accommodate many of the variable levels which characterize a sound event. These variables include frequency (or pitch), intensity (or loudness) and duration. In an alternative embodiment, spectral content (or timbre) is also detected by the system. The sensitivity of the system in terms of the ability to detect a certain intensity or loudness from a given sound source can also be adjusted in any suitable manner depending on the particular application. In one embodiment, the system can pick up intensities associated with normal conversation, such as about 75–90 dB or more. In alternative embodiments, intensities less than about 75 dB or greater than about 90 dB can be detected. However, when the signal becomes more intense, the signal strength ratio, i.e., the ratio of the direct path signal to the filtered paths' signals may not necessarily change in the same proportion. As a result, one signal may start to hide or mask the other signal such that the reflections become difficult or nearly impossible to detect, and the ability to interpret the signals is lost.

Depending on particular applications, reverberations may need to be accounted for in the signal processing algorithm. In one embodiment, the system is used in a conventional conference room where the participants are not speaking in unusually close proximity to a wall. In another embodiment, a large, non-carpeted room is used having noticeable reverberations.

Refinements to the systems described herein can be made by testing a predetermined speaker array in an anechoic chamber to check and adjust the signal processing algorithm as necessary. Further testing can also be performed on location, such as in a "typical" conference room, etc., to determine the effects of reflection, reverberation, occlusions, and so forth. Further adjustments can then be made to the algorithm, the configuration of the microphone diaphragms, the number and type of filter elements, and so forth, as needed.

Figure 4:
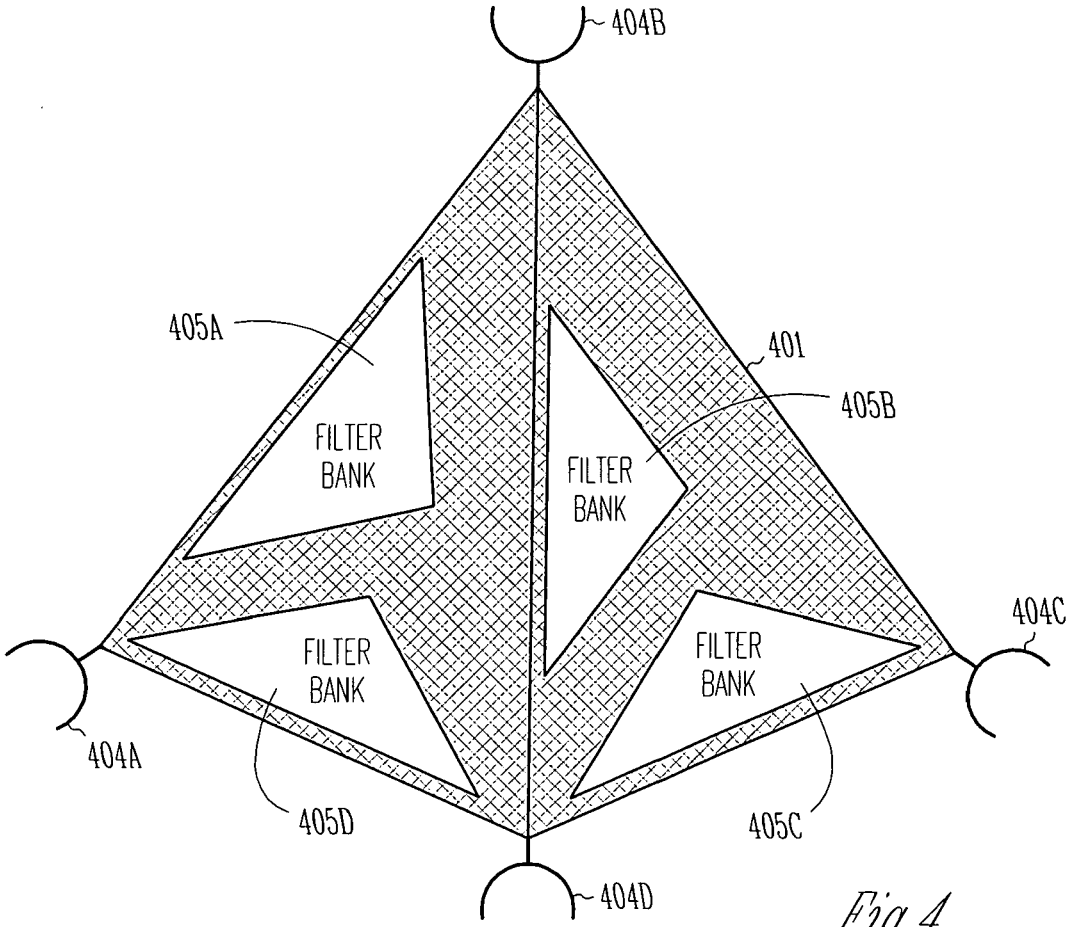
FIG. 4 is a simplified schematic of a MEMS directional microphone system having four diaphragms arranged in a tetrahedral configuration in another embodiment of the present invention.
Figure 5:
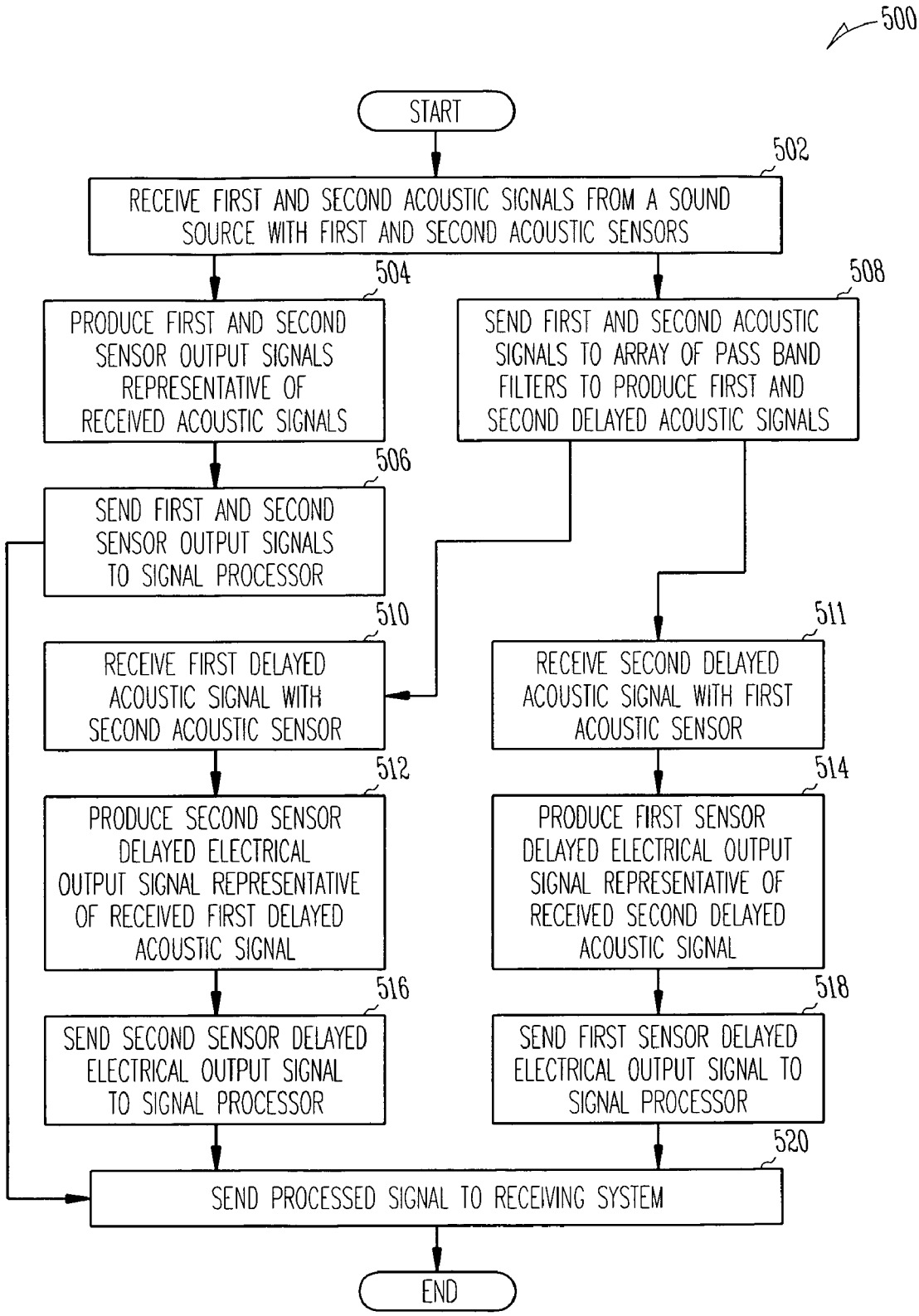
FIG. 5 is a flow chart showing a method for detecting direction from a MEMS directional microphone system to a sound source in one embodiment of the present invention.

In an alternative embodiment, as shown in FIG. 4, a three-dimensional (3D)-directional microphone system 401 comprising four diaphragms 404A, 404B, 404C and 404D arranged in a tetrahedral configuration with interconnecting filter banks 405A, 405B, 405C and 405D, respectively, is disclosed. Such a configuration allows three-dimensional sound ray directional determination, as there is now additional resolution in a third direction from a sound source, i.e., the orthogonal plane. In this way, extremely high accuracy, i.e, directionality, is provided, independent of the direction from which the sound is generated. Such resolution is likely accurate to within one to two degrees. If such a 3D-directional microphone system is designed with suitably high sensitivity and combined with appropriate computer and video systems, even the slightest movement from a moving sound source can be accurately tracked and recorded, independent of variables such as lighting conditions, and so forth. Such a system has applicability in all of the areas noted above, but may be particularly useful in advanced security systems.

In one embodiment, a process 500 for determining direction from a directional microphone system to a sound source begins with receiving 502 a first acoustic signal from a sound source with a first acoustic sensor and a second acoustic signal from the sound source with a second acoustic sensor. A first sensor electrical output signal representative of the first received acoustic signal in the first acoustic sensor and a second sensor electrical output signal representative of the second received acoustic signal in the second acoustic sensor are produced 504. The first and second sensor electrical output signals are sent 506 directly to a signal processor.

The first and second acoustic signals received by the first and second acoustic sensors, respectively, are sent 508 to an array of pass band filters, wherein the first and second acoustic signals are each delayed to produce first and second delayed acoustic signals. The first delayed acoustic signal from the array is received 510 by the second acoustic sensor and the second delayed acoustic signal from the array is received 511 by the first acoustic sensor. A second sensor delayed electrical output signal representative of the received first delayed acoustic signal in the second acoustic sensor is produced 512. A first sensor delayed electrical output signal representative of the received second delayed acoustic signal in the second acoustic sensor is also produced 514. The second sensor delayed electrical output signal is sent 516 to the signal processor and the first sensor delayed electrical output signal is also sent 518 to the signal processor. The signal processor then sends 520 the processed signal to a receiving system.

Any of the known methods for producing MEMS sensors can be used to fabricate the MEMS directional electroacoustic sensors described herein. This includes traditional bulk micromachining, advanced micromachining technologies (e.g., litogafie galvanik abeforming (LGA) and ultraviolet (UV)-based technologies), and sacrificial surface micromachining (SSM).

In bulk silicon micromachining, typically the diaphragm and backplate are fashioned on separate silicon wafers that are then bonded together, requiring some assembly procedure to obtain a complete sensor. More recently, sensors have been fabricated using a single-wafer process using surface micromachining, in which layers deposited onto a silicon substrate are patterned by etching. See, for example, Hijab and Muller, "Micromechanical Thin-Film Cavity Structures for Low-Pressure and Acoustic Transducer Applications," in Digest of Technical Papers, Transducers '85, Philadelphia, Pa., pp. 178–81 (1985). The approach used by Hijab and Muller involves depositing successive layers onto a silicon substrate to form a structure, including a layer of sacrificial material placed between a backplate and diaphragm. Access holes in the backplate allow an etchant to be introduced, which makes a cavity in, or releases, the sacrificial material, thereby forming the air gap between the electrodes. The remaining sacrificial material around the cavity fixes the equiescent distance between the diaphragm and backplate. Access holes then act as acoustic holes during normal operation of the microphone. This approach is compatible with conventional semiconductor processing techniques and is more readily adaptable to monolithic integration of sensor and electronics than are techniques requiring mechanical assembly, and is a viable approach for fabricating the MEMS directional sensor systems described herein.

See also J. Bergqvist, et al., "Capacitive Microphone with a Surface Micromachined Backplate Using Electroplating Technology," in *Journal of Microelectromechanical Systems*, Vol. 3, No. 2, June 1994, which describes a number of fabrication techniques, including fabrication of surface microstructures on silicon using metal electrodeposition combined with resist micropatterning techniques. Such a process allows for thicker layers and features with higher aspect ratios, as well as a greater choice of materials, such as copper, nickel, gold, and so forth. The processes described in Bergqvist et al., including fabrication by electrodeposition of copper on a sacrificial photoresist layer, can likely also be used to fabricate the directional sensor systems described herein. Use of sacrificial photoresist and either a wet etchant and dry oxygen-plasma etchant with an electroplated monolithic copper backplate was also reported by Bergqvist et al., in *Journal of Microelectromechanical Systems,* 3, 69 (1992). Isotropic removal of photoresist by an oxygen-plasma is a well-established technique that can be used.

In various embodiments of the present invention, the directional information can be output to third party communication devices, such as hearing aids, cell phones, transceivers, and so forth. With the various head sets or ear plugs currently in use, a sound source, such as a voice, is perceived as coming from a constant direction relative to the microphone. By using the directional microphone systems described herein, however, background noise is essentially muted, thus maximizing the ability to localize the voice, essentially providing the ability to track any given sound source.

The directional sensor systems described herein are also useful in other applications, including, but not limited to, portable computing devices, as well as robotic devices, sonar and acoustic space-mapping applications, medical tools, such as ultrasonic devices, video and audio conferencing applications, and so forth.

In yet another embodiment, a ubiquitous system can be developed in which miniature sensors are placed in various locations within specific environments to be monitored, perhaps in combination with proximity sensors, accelerometers, cameras and so forth, all controlled by a suitable controller as is known in the art. In one embodiment, the system is used for security purposes and can detect not only the sound of a single voice, but also multiple voices, footsteps, and so forth. In another embodiment, the network of sensors is coupled with an ultrasonic pinger. With appropriate modifications, the directional sensor systems can also be used in robotic guidance systems.

By utilizing a parallel filter bank that relies on a slow wave structure in a MEMS device, such as described herein, a very small sensor, such as a microphone on the order of a few micrometers, can be designed with unsurpassed ability to detect a sound source location. The use of a MEMS-based system further provides all the advantages inherent in a miniaturized system. Furthermore, since the MEMS processes that can be used to fabricate the directional sensor systems described herein are compatible with fabrication of integrated circuitry, such devices as amplifiers, signal processors, A/D converters, and so forth, can be fabricated inexpensively as an integral part of the directional sensor system at substantially reduced costs. In addition to the devices heretofore described, the systems of the present application can also be used in microspeakers, microgenerators, micromotors, microvalves, air filters and so forth.

Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the subject matter described herein. Therefore, it is manifestly intended that this invention be limited only by the claims and the equivalents thereof.

What is claimed is:

1. An apparatus comprising:

a support structure;

at least two MEMS acoustic sensors mounted on the support structure, each of the sensors adapted for receiving an acoustic signal from a source and producing a sensor output signal representative of the received acoustic signal;

a plurality of bandpass acoustic filters coupled between each of the at least two MEMS acoustic sensors, each of the filters having a pass band, the pass bands arranged for delaying sensor output signals by several wavelengths over a predetermined range of frequencies; and processing circuitry coupled to receive sensor output signals from the at least two MEMS acoustic sensors and to generate a further signal indicative of a directional heading from the sensors to the source.

2. The apparatus of claim 1 wherein the sensor output signal can be sent directly to the processing circuitry by one of the at least two MEMS acoustic sensors, further wherein the sensor output signals delayed by the plurality of bandpass acoustic filters are provided to the processing circuitry by a second of the at least two MEMS acoustic sensors.

3. The apparatus of claim 2 wherein the plurality of bandpass acoustic filters delay a mechanical perturbation from a diaphragm of a first sensor and couple the mechanical perturbation to a diaphragm of a second sensor.

4. The apparatus of claim 3 wherein a capacitance change from the first sensor and second sensor contains information allowing determination of a time delay between direct receipt of an initial pulse on the diaphragm of the first sensor and receipt of the delayed acoustic signal indicative of direct receipt of the initial pulse on the diaphragm of the second sensor, further wherein comparison of the time delay provides a heading in a first plane.

5. The apparatus of claim 4 wherein the acoustic signals delayed by the plurality of bandpass acoustic filters have frequencies ranging from less than 15 Hz up to greater than 20 kHz.

6. The apparatus of claim 4 wherein each successive bandpass acoustic filter is shifted up in frequency by a fraction of an octave from a preceding bandpass acoustic filter.

7. The apparatus of claim 6 wherein each bandpass acoustic filter is shifted up in frequency by ⅓ of an octave from the preceding bandpass acoustic filter.

8. The apparatus of claim 3 wherein the mechanical perturbation of each diaphragm is delayed by between about 10 and 100 microseconds up to one millisecond or more.

9. The apparatus of claim 1 wherein each of the bandpass acoustic filters comprises a MEMS spring and mass mechanism, further wherein the plurality of bandpass acoustic filters is mechanically coupled to the at least two MEMS acoustic sensors with a flexible MEMS device having etched silicon members.

10. The apparatus of claim 1 wherein each of the at least two MEMS acoustic sensors are comprised of a dielectric layer and a conductive layer.

11. The apparatus of claim 10 wherein the at least two MEMS acoustic sensors are capacitive microphones.

12. The apparatus of claim 11 wherein the capacitive microphones are capacitive condenser microphones formed on the support structure by surface micromachining techniques.

13. The apparatus of claim 1 further comprising components coupled to the apparatus and adapted for use in devices selected from the group consisting of a cell phone, robotic guidance system, portable computing device, ultrasonic medical device, video conferencing device, audio conferencing device, security system, sonar system, acoustic space-mapping system and a hearing aid.

14. An apparatus comprising:

a support structure;

four MEMS acoustic sensors in a tetrahedral configuration mounted on the support structure, each of the sensors having a diaphragm and adapted for receiving an acoustic signal from a source and producing a sensor output signal representative of the received acoustic signal;

a plurality of bandpass acoustic filters coupled between each of the four MEMS acoustic sensors, each of the filters having a pass band, the pass bands arranged for delaying sensor output signals by several wavelengths over a predetermined range of frequencies; and processing circuitry coupled to receive sensor output signals from the four MEMS acoustic sensors and to generate a further signal indicative of a directional heading from the sensors to the source.

15. The apparatus of claim 14 wherein each of the plurality of bandpass acoustic filters delay mechanical perturbations from one of the diaphragms and couple the mechanical perturbations to another diaphragm.

16. The apparatus of claim 15 wherein the directional heading is a three-dimensional sound ray heading accurate to within one to two degrees.

17. The apparatus of claim 16 further comprising a camera coupled to the apparatus.

18. A system comprising:

a support structure;

at least two MEMS acoustic sensors mounted on the support structure, each of the sensors adapted for receiving an acoustic signal from a source and producing a sensor output signal representative of the received acoustic signal;

a plurality of bandpass acoustic filters coupled between each of the at least two MEMS acoustic sensors, each of the filters having a pass band, the pass bands arranged for delaying sensor output signals by several wavelengths over a predetermined range of frequencies;

processing circuitry coupled to receive sensor output signals from the at least two MEMS acoustic sensors and to generate a further signal indicative of a directional heading from the sensors to the source; and a transceiver coupled to the at least two MEMS acoustic sensors.

19. The apparatus of claim 18 wherein the sensor output signal can be sent directly to the processing circuitry by one of the at least two MEMS acoustic sensors, further wherein the sensor output signals delayed by the plurality of bandpass acoustic filters are provided to the processing circuitry by a second of the at least two MEMS acoustic sensors.

20. The system of claim 18 wherein the transceiver is a cell phone.

21. A method comprising:

detecting acoustic energy from a sound source using at least two MEMS acoustic sensors residing on a support structure, the sound source having frequencies ranging from subsonic to supersonic bandwidths; and utilizing a slow wave structure in a filter bank coupled to the at least two MEMS acoustic sensors to create a time delay at all frequencies to produce shifted frequencies, further wherein off-frequency filters reject the shifted frequencies; and processing a signal from the filter bank to determine directional attributes of the acoustic energy.

22. The method of claim 21 wherein the at least two MEMS acoustic sensors are capacitive condenser microphones formed on the support structure with surface micromachining techniques.

23. The method of claim 22 wherein each of the shifted frequencies are a predetermined fraction of an octave.

24. A method comprising:

receiving a first acoustic signal from a sound source with a first MEMS acoustic sensor and a second acoustic signal from the sound source with a second MEMS acoustic sensor;

producing a first sensor electrical output signal representative of the first received acoustic signal in the first MEMS acoustic sensor and a second sensor electrical output signal representative of the second received acoustic signal in the second MEMS acoustic sensor;

sending the first and second sensor electrical output signals directly to a signal processor;

sending the first and second acoustic signals to an array of pass band filters, wherein the first and second acoustic signals are each delayed to produce first and second delayed acoustic signals;

receiving the first delayed acoustic signal with the second MEMS acoustic sensor and the second delayed acoustic signal with the first MEMS acoustic sensor;

in the second MEMS acoustic sensor, producing a second sensor delayed electrical output signal representative of the received first delayed acoustic signal;

in the first MEMS acoustic sensor, producing a first sensor delayed electrical output signal representative of the received second delayed acoustic signal; and sending the first and second sensor delayed electrical output signals to the signal processor.

25. The method of claim 24 wherein the signal processor provides processed signals to a receiving system wherein direction from the first and second MEMS acoustic sensors to the sound source is determined.

26. The method of claim 24 wherein the first and second MEMS acoustic sensors are MEMS-based capacitive microphones.

* * * * *